US006619077B1

(12) United States Patent
Robinson

(10) Patent No.: US 6,619,077 B1
(45) Date of Patent: Sep. 16, 2003

(54) LOCKING MECHANISM FOR RESTRAINTS

(76) Inventor: James L. Robinson, 59 Cottonwood La., Agawam, MA (US) 01001

( * ) Notice: Subject to any disclaimer, the term of this patent is extended or adjusted under 35 U.S.C. 154(b) by 0 days.

(21) Appl. No.: 10/116,852

(22) Filed: Apr. 5, 2002

Related U.S. Application Data

(60) Provisional application No. 60/350,691, filed on Jan. 24, 2002.

(51) Int. Cl.[7] ..... E05B 75/00
(52) U.S. Cl. ..... 70/16
(58) Field of Search ..... 70/16

(56) References Cited

U.S. PATENT DOCUMENTS

| | | | | | |
|---|---|---|---|---|---|
| 1,531,451 | A | * | 3/1925 | Neal | 70/16 |
| 1,821,566 | A | * | 9/1931 | Neal | 70/16 |
| 1,845,511 | A | * | 2/1932 | Neal | 70/16 |
| 1,872,857 | A | * | 8/1932 | Wesson et al. | 70/16 |
| 2,390,885 | A | * | 12/1945 | Kelley | 70/16 |
| 2,570,662 | A | * | 10/1951 | Gray | 70/16 |
| 2,759,349 | A | * | 8/1956 | McKee | 70/16 |
| 4,314,466 | A | | 2/1982 | Harris | |
| 4,574,600 | A | | 3/1986 | Moffett | |
| 4,694,666 | A | | 9/1987 | Bellingham et al. | |
| 4,697,441 | A | | 10/1987 | Allen | |
| 5,138,852 | A | * | 8/1992 | Corcoran | 70/16 |
| 5,461,890 | A | | 10/1995 | LeFavor | |
| 5,463,884 | A | | 11/1995 | Woo et al. | |
| 5,555,751 | A | | 9/1996 | Strickland et al. | |
| 5,613,381 | A | | 3/1997 | Savage | |
| 5,660,064 | A | | 8/1997 | Ecker et al. | |
| 5,697,231 | A | | 12/1997 | Tobin, Jr. | |
| 5,743,117 | A | | 4/1998 | Woo et al. | |
| 5,797,284 | A | | 8/1998 | Lurie | |
| 5,799,514 | A | | 9/1998 | Tobin, Jr. et al. | |
| 6,311,529 | B1 | | 11/2001 | Kang | |

FOREIGN PATENT DOCUMENTS

| | | |
|---|---|---|
| FR | 81 24030 | 6/1983 |
| RU | 2005871 C1 | 1/1994 |
| RU | 2015283 C1 | 6/1994 |

* cited by examiner

*Primary Examiner*—Suzanne Dino Barrett
(74) *Attorney, Agent, or Firm*—William F. Lang, IV

(57) ABSTRACT

A restraint locking mechanism provides a spring for biasing the bolt toward the jaw, and for resisting movement of the stop when the stop is in the double lock position. The resistance provided by the spring to movement of the stop increases to a maximum level of resistance as the stop is moved toward the single lock position, and then decreases, as contrasted with providing maximum resistance at the beginning of the stop's movement, and no resistance thereafter. Such a locking mechanism is more difficult to pick, and is less likely to be moved from its double lock position to its single lock position, by a blow to the locking mechanism.

15 Claims, 3 Drawing Sheets

LOCKING MECHANISM FOR RESTRAINTS

CROSS REFERENCE TO RELATED APPLICATION

This application claims the benefit of U.S. Provisional Patent Application No. 60/350,691, entitled HANDCUFF LOCKING MECHANISM WITH FLAT SPRING, filed Jan. 24, 2002.

BACKGROUND OF THE INVENTION

1. Field of the Invention

The present invention relates to an improved locking mechanism for restraints such as handcuffs. More specifically, the invention provides a locking mechanism having a flat spring, serving to bias the bolt against the jaw, and to resist movement of the stop when the stop is in the double locked position.

2. Description of the Related Art

Double locking restraints such as handcuffs, leg irons, and other shackles are commonly used by police to restrain those in their custody, for both the additional security that they offer, and the increased safety for the handcuffed person achieved by minimizing the likelihood that the jaw will inadvertently tighten around the person's wrist or ankle. Single locked is defined as permitting the jaw to ratchet inward to tighten the bracelet of the handcuff, but not move outward to loosen or open the bracelet. Double locked is defined as resisting both inward, tightening, and outward, loosening, movement of the jaw. However, presently available double lock mechanisms utilize a stop that is held in place by a spring-biased tab abutting a detent within the stop. Such designs provide maximum resistance to movement of the stop immediately before movement begins, with no resistance to movement provided after the stop begins moving. Such designs may not only be picked too easily, but also the stop may slide from the double locked to the single locked position if the handcuff is subjected to a sufficiently strong blow.

Others have proposed various modifications to handcuffs in an attempt to address this and other problems. For example, U.S. Pat. No. 4,314,466, issued to J. E. Harris on Feb. 9, 1982, describes a handcuff incorporating a sliding stop for preventing the bolt from moving out of engagement with the jaw. The bolt is automatically pushed into the double locked position by a lever actuated by contact with a handcuffed person's wrist as the handcuff is applied. When the stop is moved into the double locked position, the end of the stop closest to the pin slides into a recess, so that a ledge resists movement of the stop in the opposite direction. Unlocking the handcuff requires moving the stop so that it clears the ledge before turning the key to move the stop. Means for moving the stop away from the ledge include a second pin, a second keyhole for a second key, or a rod extending through the swivel. Turning the key in the opposite direction moves the bolt away from the jaw in the conventional manner.

U.S. Pat. No. 4,574,600, issued to W. P. Moffett on Mar. 11, 1986, describes a handcuff wherein a leaf spring biasing the bolt toward the jaw slides between a position wherein it blocks movement of the bolt, and a position wherein it permits movement of the bolt, but continues to bias the bolt toward the jaw. The spring is moved to the first position by inserting a pin on a handcuff key into the appropriate slot, and move to the second position by inserting and turning the key in the keyhole.

U.S. Pat. No. 4,694,666, issued to R. S. Bellingham, et al. on Sep. 22, 1987, describes a handcuff having a sliding runner that blocks movement of the bolt in one position, permitting movement in the other position. The handcuff is unlocked by turning the key to slide the runner out of engagement with the bolt, and continuing to turn the key in the same direction to move the bolt out of engagement with the jaw.

U.S. Pat. No. 4,697,441, issued to M. L. Allen on Oct. 6, 1987, describes a handcuff using a conventional locking mechanism, and having bracelets joined by a single pin, permitting the bracelets to pivot within the plane in which they are located with respect to each other, thereby remaining parallel both in use and in storage.

U.S. Pat. No. 5,138,852, issued to D. E. Corcoran on Aug. 18, 1992, describes a handcuff having a locking mechanism with a pair of individually spring-biased pawls combined with a slidable bolt for blocking movement of the pawls. The bolt includes a pair of detents for engaging a tab at the opposite end of each spring for the pawls. The handcuff has a cushioned edge, with the cushion capable of fitting between the side plates when not compressed, but not fitting between the side plates when compressed.

U.S. Pat. No. 5,461,890, issued to R. LeFavor on Oct. 31, 1995, describes a handcuff having a handle for controlling a handcuffed person. This patent does not describe or illustrate any double locking mechanism.

U.S. Pat. No. 5,463,884, issued to L. S. Woo et al. on Nov. 7, 1995, describes a handcuff having a quick release button. The quick release button may operate either the bolt but not the double lock, or may operate both the bolt and the double lock. In the second configuration wherein the quick release button operates both the bolt and double lock, it is removable so that the handcuff can be used for both training and for restraining those in custody. A similar handcuff is described in U.S. Pat. No. 5,743,117, issued to L. S. Woo on Apr. 28, 1998.

U.S. Pat. No. 5,555,751, issued to F. W. Strickland et al. on Sep. 17, 1996, describes a handcuff wherein each bracelet is closed by sliding a telescoping handle portion surrounding the handcuff's locking mechanism toward that bracelet. When the handle is moved toward the bracelet, it causes a tapered cam to engage rollers on each bracelet arm, thereby pivoting the arms to their closed position. A spring-biased bolt secures the cams in their closed position. Inserting and turning a key engages the spring-biased bolt, causing the cam springs to retract the cams and open the bracelet.

U.S. Pat. No. 5,613,381, issued to J. M. Savage on Mar. 25, 1997, describes a rigid handcuff incorporating a deadbolt for engaging a waist chain, actuated by the same cam used to move the bolts out of engagement with the jaws. This patent does not illustrate or describe any double locking mechanism.

U.S. Pat. No. 5,660,064, issued to R. J. Ecker et al. on Aug. 26, 1997, describes a handcuff having a double lock bolt with two notches for receiving a spring-biased tab, with one notch corresponding to the double locked position (wherein the bolt resists movement of the ratchet arm), and the other notch corresponding to the single locked position (wherein the bolt does not resist movement of the ratchet arm).

U.S. Pat. No. 5,697,231, issued to T. H. Tobin, Jr., on Dec. 16, 1997, describes a handcuff wherein the two bracelets are joined by a swivel link having a pair of spherical lobes connected by a neck. Each spherical lobe is secured within the lock housing of one of the two bracelets.

U.S. Pat. No. 5,797,284, issued to A. E. Lurie on Aug. 25, 1998, describes a handcuff having the position of the spring-biased bolt controlled by a cylinder lock. The cylinder lock has a central position permitting ratcheting engagement of the bolt and jaw. The cylinder lock may rotate between one position wherein movement of the bolt is resisted, and a second position disengaging the bolt from the jaw.

U.S. Pat. No. 5,799,514, issued to T. H. Tobin, Jr., et al. on Sep. 1, 1998, describes a handcuff having a locking mechanism controlled by compressed gas pressure. A spring-biased bolt engages the jaw. A piston having a default central position permitting ratcheting movement of the jaw may be moved by compressed gas pressure between one position wherein all movement of the bolt is resisted, and another position disengaging the bolt from the jaw.

U.S. Pat. No. 6,311,529, issued to J. B. Kang on Nov. 6, 2001, describes a handcuff having one or two gears engaging the bracelet's jaw, with each gear having a secondary gear engaging a pivoting, flat spring-biased ratchet arm. A sliding stop member may double lock the handcuff being moved into a position wherein it abuts the ratchet arm, resisting movement of the ratchet arm.

French Patent Application No. 2518-622-A, published Jun. 24, 1983, describes a handcuff using an arcuate ratchet biased towards its locked position by a coil spring, thereby securing the jaw. A barrel lock using a second key is used to double lock the handcuff.

Russian Patent No. 2015283-C1, published Jan. 15, 1994, describes a handcuff using a lever to engage the teeth of the jaw. An L-shaped locking bolt holds the lever in engagement with the jaw. A keyhole in the side of the lock housing permits an L-shaped key to disengage the lock.

Russian Patent No. 2005872-C1 illustrates another handcuff locking mechanism.

Accordingly, a handcuff having a double locking mechanism providing resistance to movement out of the double locked position not only at the beginning of movement, but also throughout the first portion of such movement, is desired. Additionally, a handcuff locking mechanism having a double locking mechanism dimensioned and configured so that resistance to movement of the stop increases as the stop is moved out of the double lock position is desired. Furthermore, there is a need for a handcuff having a locking mechanism that is more difficult to pick. Additionally, there is a need for a handcuff locking mechanism that will remain locked if a blow is inadvertently struck to the handcuff's locking mechanism.

SUMMARY OF THE INVENTION

The present invention provides an improved locking mechanism for restraints, providing a decreased possibility of inadvertent unlocking of the double lock mechanism, and increased difficulty in picking the lock.

The improved locking mechanism will be utilized with restraints such as handcuffs, leg irons, or other shackles, which are typically formed having a pair of side plates on either side. The side plates enclose a locking mechanism at one end, and pivotally secure a jaw between them at their other end. It is well known that the side plates also typically secure a means for joining the shackle to another identical or substantially similar shackle between them as well, for example, a chain, a hinge, etc. The jaw typically includes a plurality of ratcheting teeth at its free end, with the ratcheting teeth facing outward, so that they are dimensioned and configured to engage the locking mechanism.

The locking mechanism includes a spring-biased bolt, having one or more teeth dimensioned and configured to engage the teeth of the jaw. The bolt includes means for restraining its movement between a locked position into which it is spring-biased, and wherein it engages the jaw, and an unlocked position, wherein it permits movement of the jaw in either direction. In the illustrated example, this means includes a pivot. The bolt also includes means for engaging the flag of a handcuff key.

The locking mechanism also includes a slidably movable stop member, which slides between a first position wherein it permits movement of the bolt between the locked and unlocked positions, and a second position wherein it resists movement of the bolt away from the locked position. The stop includes at least one detent for engaging a means for securing the stop in the double locked position. In a locking mechanism of the present invention, when the stop is in a double locked position, the same spring that biases the bolt toward its locked position will engage one of these detents, thereby securing the stop in the double locked position. The locking mechanism also includes a double lock pin, which may be pushed utilizing a post on the handcuff key to push the stop from the single locked first position to the double locked second position, and means for engaging the flag of a handcuff key so that rotating the key may move the stop from the double locked position to the single locked position.

Many of the advantages of the improved locking mechanism are provided by the configuration of the spring. A preferred spring is a flat spring having a pair of J-shaped tips, with one J-shaped tip dimensioned and configured to engage the bolt, and the second J-shaped tip dimensioned and configured to engage either the lock mechanism housing, or the detent within the stop. The spring is preferably angled at an acute angle with respect to the stop. Therefore, as the stop moves from the double locked position to the single locked position, the resistance to this movement supplied by the spring will gradually increase until a maximum level of resistance is reached, at which point the spring will disengage from the stop, permitting the stop to move the remainder of the distance to the single locked position. In presently available handcuff locking mechanisms, a spring-biased member engages a detent in the stop when the stop is in the double locked position, exiting the detent as soon as the stop begins to move away from the double locked position. Therefore, in a conventional handcuff, maximum resistance to movement of the stop is provided only at the beginning of the stop's movement. By providing resistance to movement of the stop over a greater portion of the stop's movement from the double lock position to the single lock position, and by making the point of maximum resistance later in that movement, the locking mechanism becomes more resistant to picking attempts and less likely to move from its double locked position when subjected to a hard blow.

These and other aspects of the invention will become apparent through the following description and drawings.

BRIEF DESCRIPTION OF THE DRAWINGS

Like reference numbers denote like elements throughout the drawings.

DETAILED DESCRIPTION

Figure 1:
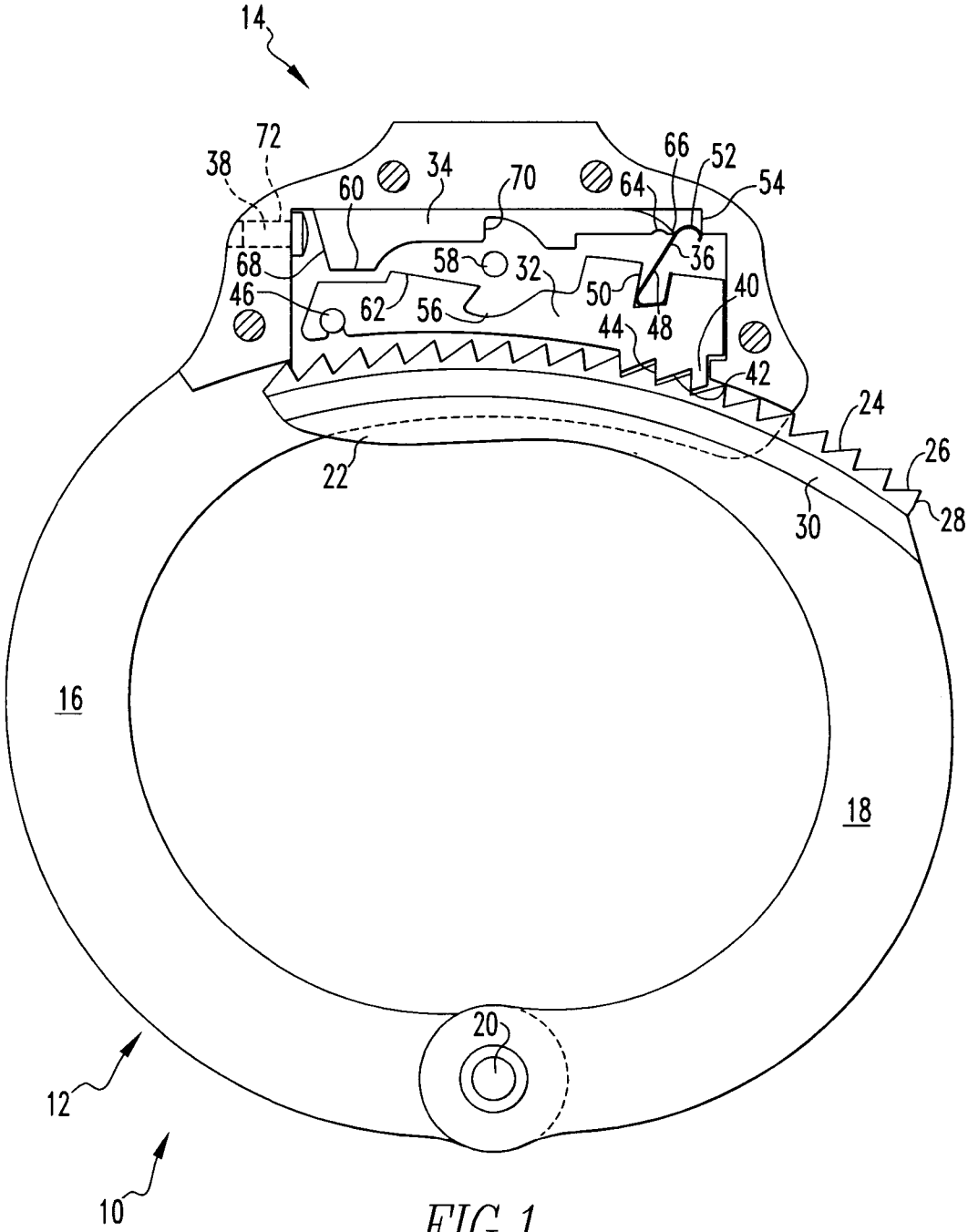
FIG. 1 is a side view of a handcuff according to the present invention, with one of the two side plates removed for clarity, showing the components of the lock in the single locked position.

The present invention provides an improved locking mechanism for restraints such as handcuffs, leg irons, belly chains, and other shackles commonly used by law enforcement personnel.

Referring to the figures, a single bracelet 10 utilizing the present invention is illustrated. The bracelet 10 includes a pair of mirror image side plates 12 (one of which has been omitted for clarity). The side plates 12 define a lock housing 14 and an arm 16, dimensioned and configured to fit approximately halfway around a wrist or ankle. A jaw 18, also dimensioned and configured to fit partway around a wrist or ankle, is pivotally secured to the arm 16 at pivot 20, opposite the lock housing 14. The outside edge of the free end 22 of the jaw 18 includes a plurality of ratchet teeth 24, having an angled front surface 26, and a back surface 28 generally perpendicular to the jaw 18. A channel 30 may extend along the free end 22 of the jaw 18. The channel 30 is dimensioned and configured to mate with a guide ridge (not shown and well known in the art of restraints) on each side plate 12.

The lock housing 14 contains a bolt 32, a stop 34, a spring 36, and a double lock pin 38. The bolt 32 includes one or more teeth 40, with each tooth 40 having an angled surface 42 corresponding to the angled surface 26 of the jaws teeth, and a perpendicular surface 44 corresponding to the perpendicular surface 28 of the jaws teeth. The bolt 32 is dimensioned and configured so that its teeth 40 releasably engage the teeth 24 of the jaw 18, so that the corresponding angled surfaces 26, 42 permits the jaw 18 to be moved inward to tighten the bracelet 10, but the corresponding vertical surfaces 28, 44 resist loosening the bracelet 10. A preferred means by which the bolt 32 will releasably engage the jaw 18 include the pivot 46, at the opposite end of the bolt 32, thereby permitting the teeth 40 to be pivoted towards or away from the jaw 18. The spring 36 is dimensioned and configured to bias the bolt 32 towards its locked position, wherein it engages the teeth 24 of the jaw 18. A preferred spring 36 includes a first J-shaped end 48, dimensioned and configured to fit within a recess 50 within the bolt 32. The opposite J-shaped end 52 of the spring 36 is preferably dimensioned and configured to engage the lock housing 14, possibly at corner 54, and the stop 34, as will be explained below. The spring 36 is preferably made from a material having a high modulus of resilience, for example, high carbon steel, stainless steel, or titanium. The bolt 32 also contains a cut-out 56, adjacent to the key pin 58 within the lock housing 14, and dimensioned and configured to receive the flag of a standard handcuff key (not shown but well known in the art of restraints).

The stop 34 is dimensioned and configured to releasably secure the bolt 32 in its locked position. The stop 34 includes a camming surface 60, corresponding to the surface 62 of the bolt. The opposite end of the stop 34 includes a detent 64, dimensioned and configured to receive the J-shaped end 52 of the spring 36. The stop terminates in a wedge 66 adjacent to the detent 64, with the end 52 of the spring 36 bearing against both the corner 54 and the wedge 66. The stop 34 also includes a pin-engaging surface 68, against which the slidably mounted double lock pin 38 will be pushed when the pin 38 is pushed inward, and a key-engaging cut-out 70, dimensioned and configured to engage the flag of a standard handcuff key.

The double lock pin 38 is slidably mounted within the channel 72 of the lock housing 14.

In use, the default position of the bracelet 10 will be the single locked position illustrated in FIG. 1. In this single locked position, the bolt 32 is biased against the jaw 18 by the spring 36, bearing against the corner 54 of the lock housing 14. The stop 34 is in its left-most position, wherein the corresponding camming surfaces 60, 62 do not engage each other, permitting the bolts 32 to pivot away from the jaw 18 against the pressure of the spring 36. In this position, inward movement of the jaw 18 will cam the angled surfaces 26 against the angled surfaces 42, pushing the bolts 32 towards its unlocked position, away from the jaw 18, and permitting the jaw 18 to move towards the arm 16. Attempting to move the jaw 18 away from the arm 16 will cause the vertical surfaces 28, 44 to abut, resisting outward movement of the jaw 18.

Figure 2:
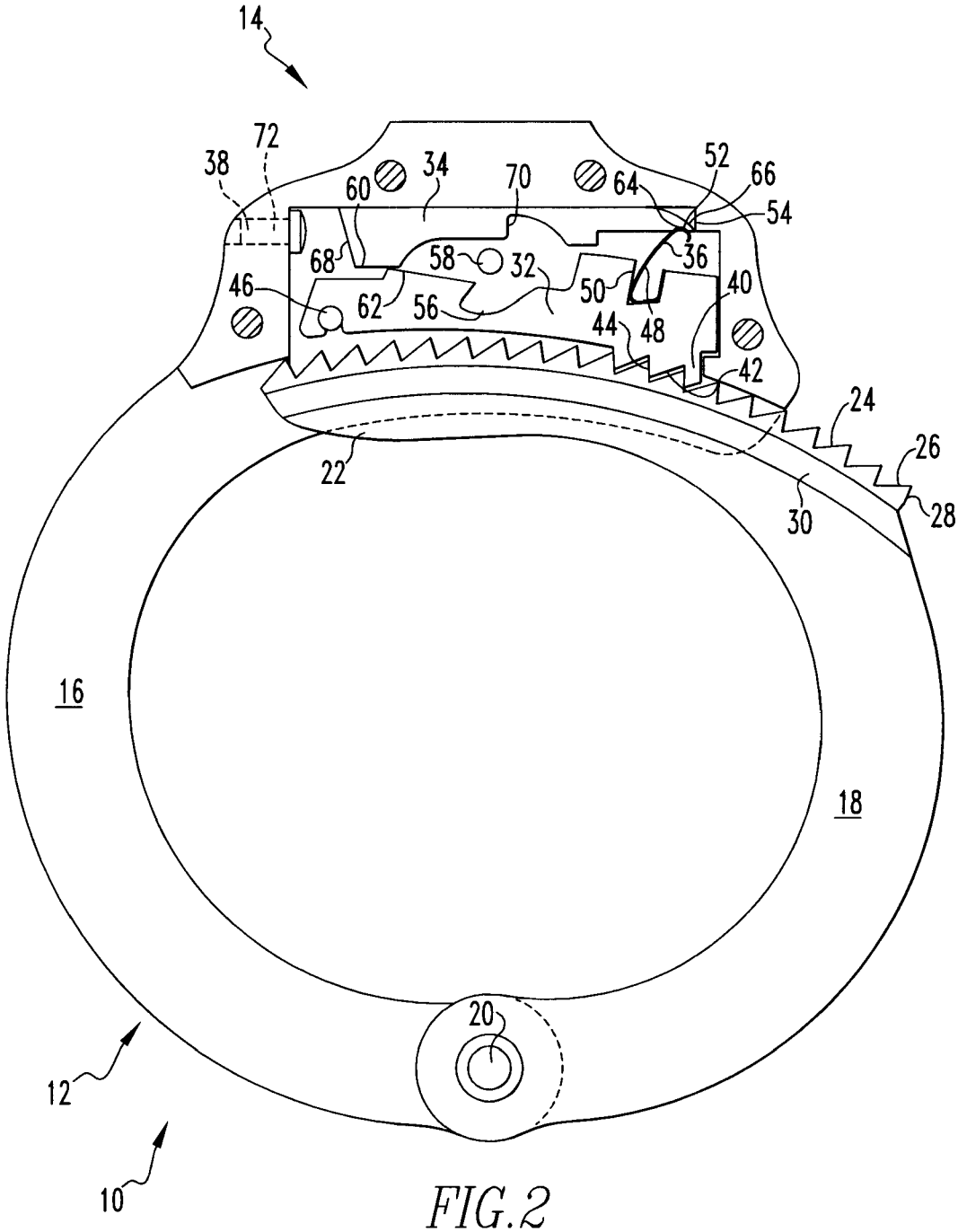
FIG. 2 is a side view of a handcuff according to the present invention, with one of the two side plates removed for clarity, showing the components of the locking mechanism in the double locked position.

When it is desired to double lock the bracelet 10, for example, when the bracelet is around the wrist or ankle of an individual in custody, a pin on a handcuff key may be used to push inward on the double lock pin 38, thereby moving the stop from its left-most position of FIG. 1 to its right-most position of FIG. 2. In the position of FIG. 2, the camming surfaces 60, 62 abut each other, thereby resisting movement of the bolt 32 away from the jaw 18. Therefore, the interaction of the teeth 24 and the teeth 40 prevent movement of the jaw 18 in either direction. Additionally, the J-shaped end 52 of the spring 36 has now engaged the detent 64 in the stop 34, thereby securing the stop 34 in this double locked position. When the stop 34 was moved from the position of FIG. 1 to the position of FIG. 2, the wedge 66 forced the J-shaped end 52 of the spring 36 away from the corner 54 of the housing 14 and into the detent 64. In this position, the spring 36 not only biases the bolt 32 against the jaw 18, but also biases the stop 34 in this double locked position.

Figure 3:
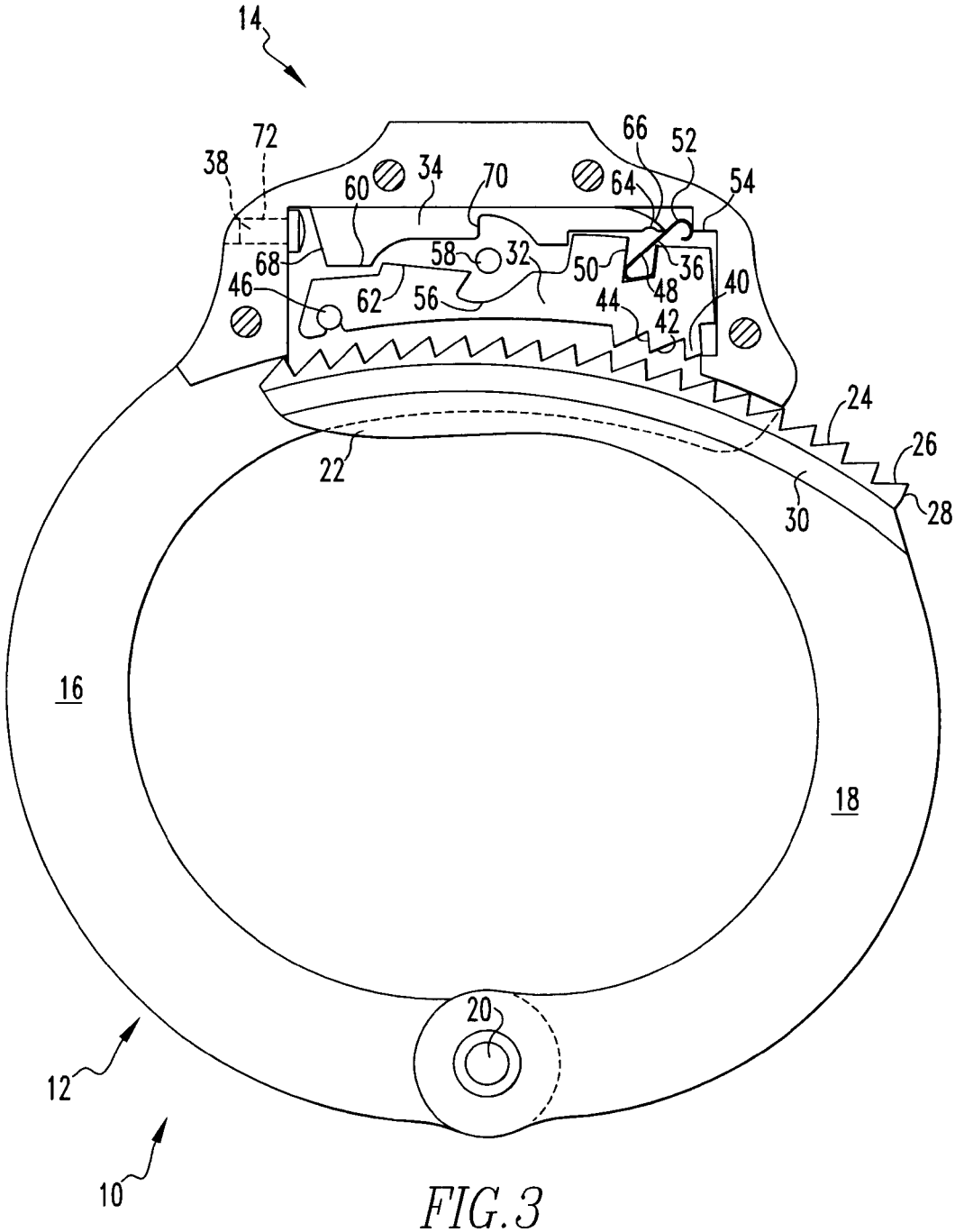
FIG. 3 is a side view of a handcuff according to the present invention, with one of the two side plates removed for clarity, showing the components of the handcuff in the unlocked position.

To unlock the handcuff, a standard handcuff key (not shown, and well known in the art of restraints) is inserted into the keyhole (not shown) and onto the key pin 58. The key is first turned so that the key flag engages the cut-out 70 within the stop 34, pushing the stop 34 into the position illustrated in FIGS. 1 and 3, wherein the stop 34 permits the bolts 32 to be pushed away from the jaw 18 against the bias of the spring 36. Next, the key is rotated the opposite direction to engage the cut-out 56 in the bolt 32, thereby pulling the bolt 32 away from the jaw 18, to the position illustrated in FIG. 3. With the bolt in this position, the jaw 18 may freely move in either direction. Removing the key from the lock housing 14 will cause the spring 36 to push the bolt 32 back to its single locked position of FIG. 1.

Referring back to FIG. 2, it becomes apparent that moving the stop 34 from the double lock position illustrated to the single lock position requires moving the stop 34 against the bias of the spring 36. Because the spring 36 is at an acute angle with respect to the stop 34, moving the stop 34 will increase the resistance of the spring 36 to this movement until the spring 36 is pulled into a vertical position. Continued movement of the stop 34 past this point of maximum resistance, the spring 36 will exit the detent 64, freeing the stop 34 for the remainder of its movement. Because resistance to movement of the stop 34 from the double lock position occurs over a larger portion of its range of motion than in a conventional locking mechanism, and because the point of maximum resistance to this motion occurs after the stop 34 has already moved some distance, a locking mechanism of the present invention is more difficult to pick than a conventional handcuff locking mechanism, and is also less likely to leave its double locked position as a result of a blow to the locking mechanism.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A locking mechanism for restraints, said restraints comprising a pair of side plates securing a pivotally mounted jaw therebetween, the jaw having a plurality of ratchet teeth, said side plates further defining a lock housing, said locking mechanism comprising:

a bolt having at least one ratchet tooth dimensioned and configured to releasably engage the ratchet teeth of said jaw to permit tightening ratcheting movement of the jaw, and to resist outward, loosening movement of the jaw, said bolt moving between a locked position wherein said ratchet teeth of said bolt engage said ratchet teeth of said jaw, and an unlocked position wherein said ratchet teeth of said bolt are disengaged from said ratchet teeth of said jaw, a stop dimensioned and configured for movement between a single locked position wherein said stop permits movement of said bolt between the locked and unlocked positions of the bolt, and a double locked position wherein said stop resists movement of said bolt from said locked position, and a spring including a pair of J-shaped ends, one of said J-shaped ends being dimensioned and configured to engage said bolt, the other of said J-shaped ends being dimensioned and configured to engage said stop when said stop is in said double locked position, and to engage said lock housing in said single locked position, the spring being dimensioned and configured to bias said bolt towards said locked position, and to resist movement of said stop from said double locked position with increasing force until a maximum resisting force is reached, said maximum resisting force occurring after said stop has moved from said double locked position.

2. The locking mechanism according to claim 1, wherein said spring is a flat spring.

3. The locking mechanism according to claim 1, wherein said spring is oriented at an acute angle from said stop.

4. The locking mechanism according to claim 1, wherein said spring is made from a metal selected from the group consisting of high carbon steel, stainless steel, and titanium.

5. A locking mechanism for restraints, said restraints comprising a pair of side plates securing a pivotally mounted jaw therebetween, the jaw having a plurality of ratchet teeth, said side plates further defining a lock housing, said locking mechanism comprising:

means for releasably engaging said jaw to permit tightening ratcheting movement of the jaw, and to resist outward, loosening movement of the jaw;

means for releasably resisting inward, tightening movement of said jaw;

means for resisting movement of said means for releasably resisting inward, tightening movement of said jaw, said means for resisting movement providing increasing resistance during movement of said means for releasably resisting inward, tightening movement of said jaw until a maximum resisting force is reached, said maximum resisting force occurring after said means for resisting movement of said means for releasably resisting inward, tightening movement of said jaw has moved from said double locked position, the means for resisting movement of the means for releasably resisting inward, tightening movement of the jaw including a flat spring having a pair of J-shaped ends, one of said J-shaped ends being dimensioned and configured to engage said means for releasably engaging said jaw, the other of said J-shaped ends being dimensioned and configured to engage said releasably resisting inward, tightening movement of said jaw when said releasably resisting inward, tightening movement of said jaw is in said double locked position, and to engage said lock housing in said single locked position.

6. The locking mechanism according to claim 5, wherein said spring is oriented at an acute angle from said means for releasably resisting inward, tightening movement of said jaw.

7. The locking mechanism according to claim 5, wherein said spring is made from a metal selected from the group consisting of high carbon steel, stainless steel, and titanium.

8. A restraint having at least one bracelet, said bracelet comprising:

a pair of side plates securing a pivotally mounted jaw therebetween, said jaw having a plurality of ratchet teeth, said side plates further defining a lock housing; and a locking mechanism within said lock housing, said locking mechanism comprising:

a bolt having at least one ratchet tooth dimensioned and configured to releasably engage the ratchet teeth of said jaw to permit tightening ratcheting movement of the jaw, and to resist outward, loosening movement of the jaw, said bolt moving between a locked position wherein said ratchet teeth of said bolt engage said ratchet teeth of said jaw, and an unlocked position wherein said ratchet teeth of said bolt are disengaged from said ratchet teeth of said jaw;

a stop dimensioned and configured for movement between a single locked position wherein said stop permits movement of said bolt between the locked and unlocked positions of the bolt, and a double locked position wherein said stop resists movement of said bolt from said locked position; and a spring including a pair of J-shaped ends, one of said J-shaped ends being dimensioned and configured to engage said bolt, the other of said J-shaped ends being dimensioned and configured to engage said stop when said stop is in said double locked position, and to engage said lock housing in said single locked position, the spring being dimensioned and configured to bias said bolt towards said locked position, and to resist movement of said stop from said double locked position with increasing force until a maximum resisting force is reached, said maximum resisting force occurring after said stop has moved from said double locked position.

9. The restraint according to claim 8, wherein said spring is a flat spring.

10. The restraint according to claim 8, wherein said spring is oriented at an acute angle from said stop.

11. The restraint according to claim 8, wherein said restraint is a handcuff.

12. The restraint according to claim 8, wherein said restraint is a leg iron.

13. The restraint according to claim 8, wherein said restraint is a belly chain.

14. The restraint according to claim 8, wherein said restraint is a shackle.

15. The restraint according to claim 8, wherein said spring is made from a metal selected from the group consisting of high carbon steel, stainless steel, and titanium.

* * * * *

UNITED STATES PATENT AND TRADEMARK OFFICE

CERTIFICATE OF CORRECTION

PATENT NO. : 6,619,077 B1
DATED : September 16, 2003
INVENTOR(S) : James L. Robinson It is certified that error appears in the above-identified patent and that said Letters Patent is hereby corrected as shown below:

Column 4,
Line 45, “the-stop” should read -- the stop --.

Column 8,
Lines 13 and 15, insert -- means for -- prior to “releasably”.

Signed and Sealed this

Twenty-fourth Day of February, 2004

JON W. DUDAS
*Acting Director of the United States Patent and Trademark Office*